United States Patent [19]

Fapiano

[11] Patent Number: 4,521,859

[45] Date of Patent: Jun. 4, 1985

[54] METHOD OF IMPROVED GAGE CONTROL IN METAL ROLLING MILLS

[75] Inventor: Donald J. Fapiano, Salem, Va.

[73] Assignee: General Electric Company, Salem, Va.

[21] Appl. No.: 436,973

[22] Filed: Oct. 27, 1982

[51] Int. Cl.[3] ..... G06F 15/46; B21B 37/00

[52] U.S. Cl. ..... 364/472; 364/476; 364/571; 72/8; 72/16

[58] Field of Search ..... 364/472, 476, 571, 563; 72/8, 11, 15, 10, 19, 20

[56] References Cited

U.S. PATENT DOCUMENTS

| | | | |
|---|---|---|---|
| 3,194,035 | 7/1965 | Smith | 72/8 |
| 3,331,229 | 7/1967 | Neumann et al. | 72/8 |
| 3,448,600 | 6/1969 | Coleman et al. | 72/8 |
| 3,460,365 | 8/1969 | Howard | 72/21 |
| 3,478,551 | 11/1969 | Alsop | 72/8 |
| 3,580,022 | 5/1971 | Waltz et al. | 72/8 |
| 3,881,335 | 5/1975 | Cook | 72/11 |
| 3,882,705 | 5/1975 | Fox | 72/21 |
| 3,889,504 | 6/1975 | Ichiryu et al. | 72/8 |
| 3,893,317 | 7/1975 | Clarke | 72/20 |
| 3,920,968 | 11/1975 | Imai et al. | 235/151.1 |
| 3,926,024 | 12/1975 | Mornas | 72/8 |
| 3,928,994 | 12/1975 | Ichiryu et al. | 72/8 |
| 4,036,041 | 7/1977 | Ichiryu et al. | 72/8 |
| 4,038,848 | 8/1977 | Ichiryu et al. | 72/8 |
| 4,126,027 | 11/1978 | Smith, Jr. et al. | 72/11 |
| 4,222,254 | 9/1980 | King, Jr. et al. | 72/8 |
| 4,299,104 | 11/1981 | Hayama | 72/20 |
| 4,398,254 | 8/1983 | Kondo | 364/472 |

FOREIGN PATENT DOCUMENTS

| | | |
|---|---|---|
| 491836 | 4/1953 | Canada . |
| 1321116 | 6/1973 | United Kingdom . |
| 1479668 | 7/1977 | United Kingdom . |
| 1540952 | 2/1979 | United Kingdom . |

OTHER PUBLICATIONS

"FARE", (Fourier Analyzer of Roll Eccentricity), Detector and Control System for Elimination of Roll Eccentricity", 1973, Sep., I.H.I. by Imai and Suzuki, pp. 1-12.

"Eccentricity Filter for Rolling Mills", by Waltz and Reed, Instrumentation in the Metals Industry, vol. 21, pp. 1-9, (1971).

*Primary Examiner*—John R. Lastova

*Attorney, Agent, or Firm*—Arnold E. Renner

[57] ABSTRACT

In a metal rolling mill of the type employing automatic gage control (AGC) to control the gap between the rolls utilized to reduce the thickness or gage of a workpiece passed between the rolls, there is provided a method for compensating for roll irregularities (e.g., eccentricity and ovalness). The method provides for developing signals proportional to the roll separation force and the roll rotational speed and isolating from the force signal those cyclic components which have a frequency which is an integral multiple of the roll rotational speed. The values of these cyclic components are then multiplied by a factor greater than unity and the resulting product is subtracted from the original force signal to thus develop a modified force signal which is utilized to control the AGC and hence the roll gap to thus compensate for roll irregularities.

5 Claims, 5 Drawing Figures.

METHOD OF IMPROVED GAGE CONTROL IN METAL ROLLING MILLS

BACKGROUND OF THE INVENTION

The present invention relates generally to metal rolling mills and more particularly to a method of compensating for variations in workpiece gage due to irregularities in mill rolls.

In the discipline of metal rolling, it is a very common practice to employ what is commonly known as an automatic gage control (AGC) as a form of control of the workpiece thickness. In the well known form of gage control, the BISRA "gagemeter" system, (U.S. Pat. No. 2,680,978), a signal proportional to mill deflection is combined with a signal proportional to unloaded roll opening to form a signal proportional to thickness delivered from the rolling mill, which is used in a closed-loop control system to maintain desired workpiece thickness.

Such systems respond correctly to variations in strip characteristics, such as entry thickness and hardness, but incorrectly to variations in the roll gaging caused by roll irregularities.

As used in the present application, roll irregularities are basically of two kinds, both of which result from the imperfect grinding of the rolls or the supporting journals. The first of these irregularities is what is commonly referred to as eccentricity. Eccentricity is that irregularity which results from the roll having an improper center of rotation even though the exterior surface of the roll may be perfectly circular. The second irregularity is what is commonly referred to as ovalness and is that condition which exists when the roll is not of perfect circular configuration but does in fact have an oval cross-sectional configuration. Each of these irregularities produces a cyclic variation in the workpiece gage which is related to the roll rotational speed. In the case of eccentricity, the variation occurs once for each revolution of the roll. In the case of ovalness, the cyclic variation occurs twice for each revolution of the roll.

In a four-high mill, that is a mill having two backup rolls and two work rolls, although ovalness is sometimes a problem, the most common irregularity for the backup rolls is eccentricity resulting from improper centering of the roll journals during the grinding of the roll body. The work rolls in this particular situation are normally not supported at their ends but are in fact "free floating" and thus ovalness becomes the primary consideration. In a two-high stand in which only work rolls are present, the work rolls may exhibit both eccentricity and ovalness.

These problems of eccentricity and ovalness have been recognized and addressed in the prior art. For example, in U.S. Pat. No. 3,580,022, "Rolling Mill Including Gage Control" by M. D. Waltz et al. (issued May 25, 1971), there is provided a scheme for neutralizing the effects of eccentricity by essentially blocking out or masking the eccentricity force signal variations to prevent hunting by the AGC screw system. This system does not, however, compensate for the gage errors produced in the workpiece by such eccentricity.

Others have attempted by various means, such as templates patterned after the actual roll profile, to compensate for irregularities such as eccentricity and ovalness. Frequency analysis methods have also been proposed; for example, that described in U.S. Pat. No. 3,928,994 by K. Ichiryu et al., entitled "Thickness Control System for a Rolling Mill", issued Dec. 30, 1975, identifies the periodic components of output thickness variation from continuous measurement and statistical analysis of these variations for use in a gage control system. Like the method of Waltz, this method serves only to mask the periodic force components rather than compensate the roll irregularities. These systems, however, are expensive to implement and difficult to maintain since they normally require additional equipment physically coupled to the main support rolls which must be disconnected and reconnected each time these are changed and, in some methods, additional thickness gaging means.

A different approach has been used where it is expected that gage variations due to roll irregularities may exceed those due to entering thickness or hardness variations. In such cases, the roll gap control system may be designed to hold roll separating force constant. Where eccentricity frequency is much lower than the response limits of the roll gap control, this provides a very effective means of reducing gage variations due to roll irregularities, but it is totally ineffective in correcting for entering thickness or hardness variations.

A system which performs essentially as a constant gap or gagemeter control for strip related disturbances, but essentially as a constant force control for disturbances produced by the mill rolls would thus be ideal.

SUMMARY OF THE INVENTION

It is, therefore, an object of the present invention to provide an improved gage control in a metal rolling mill.

It is another object, in a metal rolling mill, to provide an improved method for compensating for gage variations due to roll irregularities.

It is a further object to provide, in a metal rolling mill, a gage control system which operates to hold force nearly constant at frequencies which are selected multiples of roll rotational frequency and as a conventional gagemeter control at other frequencies.

It is a still further object to provide a method of gage control in a metal roll which compensates for roll irregularities through the use of a filter network responsive to signals normally already present in conventional gage control systems.

The foregoing and other objects are achieved in accordance with the present invention by providing, in a metal rolling mill, including adjusting means controlled by an AGC system for controlling the roll gap, a method for compensating for cyclic workpiece gage variations which result from roll irregularities. This method first includes the development of a force signal proportional to the roll separation force occasioned by the workpiece between the rolls and a speed signal proportional to the rotational speed of the rolls. These two signals are then employed to isolate from the force signal those cyclic components which have frequencies which are integral multiples of the roll rotational speed. These cyclic components are then multiplied by a multiplication (gain) factor which is greater than unity to provide a product which is subtracted from the force signal to provide a modified force signal. This modified force signal is applied to the AGC system for controlling the gap between the rolls.

BRIEF DESCRIPTION OF THE DRAWING

Although the novel features of the present invention are set forth in particularity in the claims annexed to and forming a part of this specification, the invention, both as to organization and content will be better understood and appreciated along with the other objects and features thereof from the following detailed description taken in conjunction with the accompanying drawings in which:

DETAILED DESCRIPTION

Figure 1:
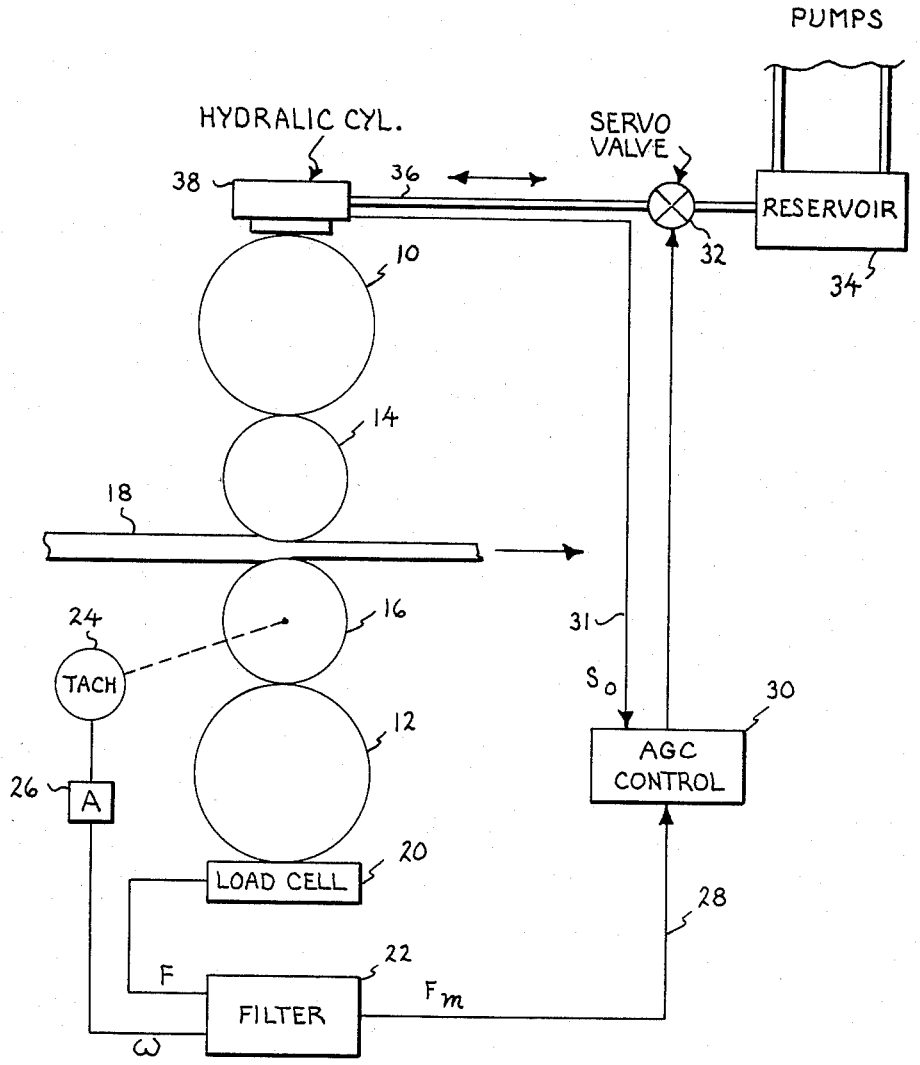
FIG. 1 is a schematic representation of a metal rolling mill stand employing the control of the present invention in accordance with the preferred embodiment.

Referring now to FIG. 1, there is shown in its basic form a single stand of a metal rolling mill. As will be understood, those elements of the stand such as the supports, bearings, chocks, etc., have not been illustrated for simplicity's sake, it being understood that all these elements are well known in the art. The stand as shown in FIG. 1 could be one stand of a tandem mill or the single stand of a reversing mill. As illustrated, the stand includes an upper backup roll 10 and a lower backup roll 12 and a corresponding upper work roll 14 and a lower work roll 16. A metal workpiece 18 is passed between the work rolls to effect reduction in the thickness of the workpiece. A load cell 20 associated with the stand provides an output signal (F) which is proportional to the force occasioned by passing the workpiece between the work rolls. The force signal F is applied to a filter network 22 which forms the essence of the present invention and which will be discussed in detail later.

Each of the work rolls 14 and 16 is normally driven by an individual drive motor (not shown) and there is associated with one of the work rolls (e.g., roll 16) a tachometer 24 which provides an output signal proportional to the rotational speed of that roll. It will be appreciated that since the diametral relationship of the work rolls and the backup rolls is known for any given mill, the speed of the backup rolls also can be readily determined by the single tachometer. The output of the tachometer is applied to a suitable amplifier 26 which serves to scale the tachometer output signal. The output of the amplifier 26 is a signal $\omega$ which serves as a second input to the filter 22.

The output of filter 22 is a modified force signal ($F_m$) which is applied by way of a line 28 to an AGC control 30. A second signal, $S_o$, proportional to the unloaded roll gap opening is delivered, via line 31, to control 30 from a suitable position sensor (not shown) associated with a hydraulic cylinder 38. Control 30, as is customary and well known in the art, serves to effect control of the workpiece gage or thickness (h) in accordance with the well known gage meter relationship:

$$h=(F/M)+S_o; \text{ wherein,} \quad (1)$$

F=roll separation force
M=mill modulus
$S_o$=unloaded roll gap or opening.

The output of the AGC control 30 forms the input to a servo valve 32 which is connected at its input side to a reservoir 34 which is supplied with pressurized fluid (e.g., oil) from suitable pumps (not shown). Under the control of the AGC 30, the servo valve, by way of conduit means 36 supplies fluid under pressure to the hydraulic cylinder 38 which in turn governs the roll opening of the mill stand.

To those well versed in the metal rolling discipline, it will be apparent that if the filter 22 were not present and the force signal F were taken directly to the AGC control 30, that depicted in FIG. 1 would be a typical AGC control system. It will also be apparent to those familiar with the aforementioned U.S. Pat. No. 3,580,022 that the illustration of FIG. 1 does not differ substantially therefrom, the difference being, as will become apparent in the selection and the utilization of the filter 22.

Figure 2:
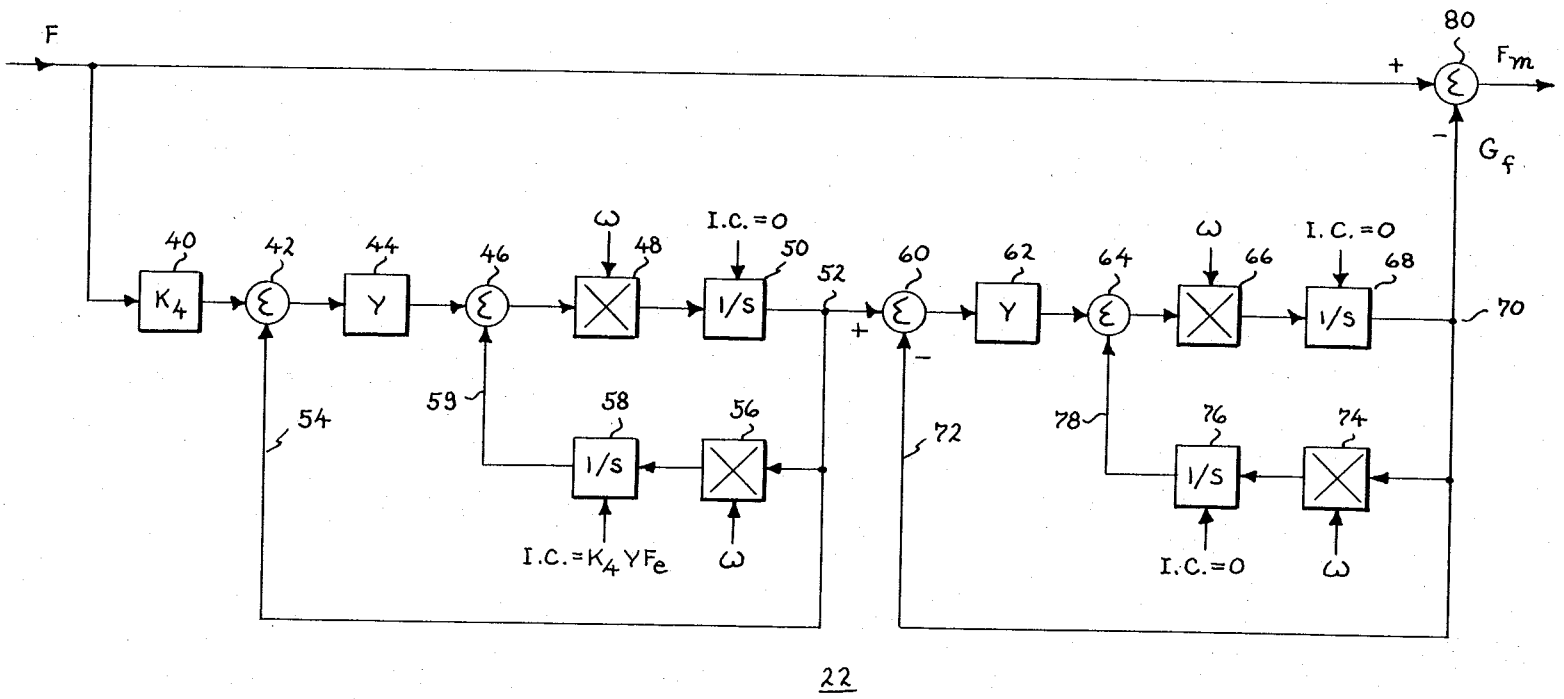
FIG. 2 is a transfer functional schematic diagram of a filter network for use in accordance with the preferred embodiment of the present invention; and, FIGS. 3, 4, and 5 are graphical representations of various parameter relationships helpful in the understanding of the present invention.

Reference is now made to FIG. 2 which illustrates, in transfer function schematic form, the filter 22 in accordance with the present invention. In its preferred embodiment, the active portion of the filter 22 provides an output signal $G_f$ defined by the following relationship:

$$G_f = K_4\left[\frac{Y\cdot\omega_1\cdot s}{s^2+Y\cdot\omega_1\cdot s+\omega_1^2}\right]^n, \text{ wherein} \quad (2)$$

$K_4$=selected multiplier
Y=filter bandwidth constant
$\omega_1$=tuned frequency of filter
s=Laplace operator ($j\omega_2$, wherein $\omega_2$ is any cyclic variation)
n=number of stages (2 in the two stage illustrated embodiment of FIG. 2)

As illustrated and indicated above, the filter 22 is a two stage filter. The force signal F is first applied to a gain block 40 labelled $K_4$ which is the overall gain of the filter, the determination of which will be subsequently explained. Suffice it to say for the present, $K_4$ must have an absolute magnitude greater than unity in order to provide the compensation of the present invention. The output of gain block 40 is applied as one input to a summing junction 42, the output which forms the input to an additional gain block 44 (Y). As will be discussed hereinafter, the term Y is a preselected filter bandwidth constant. The output of block 44 is applied to a two input summing junction 46, the output of which serves as one input to a multiplier 48, the second input of which is the speed signal $\omega$ from the amplifier 26 (FIG. 1). The product of block 48 is applied to a first integrating circuit 50 which has an initial condition (I.C.) equal to zero. The output of the integrator 50, the output of the first is stage of the filter, appears at node 52. The signal at node 52 is applied by way of line 54 to form the second input to the summing junction 42. This signal also serves as one input to a second multiplier 56 also having the speed signal $\omega$ applied thereto. The output of multiplier 56 is applied to a second integrator 58 having an initial condition (I.C.) set to the value $K_4YF_e$, wherein $F_e$ is the anticipated force value upon entry of the strip between the work rolls of the mill. The output at integrator 58 serves as the second input to the summing junction 46.

The signal appearing at node 52 further serves as the input to the second filter stage which is essentially identical to the first with one exception. As illustrated, the signal at node 52 is applied to a summing junction 60 the output of which forms the input to a Y block 62 which in turn supplies one input to a summing junction 64. The output of junction 64 is applied to a multiplier 66 having the $\omega$ speed signal as a second input. The output of multiplier 66 is applied to an integrator 68 which also has an initial condition (I.C.) of zero. The output of the integrator 68 as seen at node 70 is the $G_f$ signal. This signal also serves as a feedback by way of line 72 to the second input of the summing junction 60 and as the input to a second feedback path including the series connection of an additional multiplier 74, having as its second input the $\omega$ signal, and an additional integrator 76. Integrator 76 corresponds to integrator 58 of the first stage except that in this case its initial condition (I.C.) is zero. The output of the integrator 76 is applied by way of line 78 as the second input to the summing junction 64.

The $G_f$ output signal, since the active portion of the filter 22 is of the band pass type, has only those cyclic components which are close in frequency to the filter's tuned frequency, $\omega_1$, established by the speed signal. These components, however, are of an amplified nature such that when they are combined with the force signal F in summing junction 80, the resultant modified force signal $F_m$, which is applied by line 28 to the AGC control 30 (FIG. 1), serves to provide more than merely masking of the cyclic component(s). The $F_m$ signal as applied to the AGC forces the AGC to correct for gage variations due to such cyclic variations such as eccentricity and ovalness. In the present illustration, compensation is for eccentricity which has a cyclic variation of once per revolution of the appropriate roll being compensated for. If ovalness were also a problem in a particular mill, a similar filter to that disclosed but tuned to twice the rotational speed of the particular roll could be employed in parallel with that disclosed.

It should be noted that the effect on the AGC achieved by the present invention is contrary to that which is normally to be expected. That is, in a pure AGC system an increase in the force signal would connote an increase in input gage or hardness and would result in the AGC system causing the rolls to move closer together to correct for this increase in thickness. In the present instance, however, it is recognized that, due to the roll irregularity, to provide proper correction, the roll gap must be increased and this is precisely the function which is achieved. Thus, the system behaves like a force regulator at frequencies approximating preselected integral multiples of rotational frequency and like the typical gage meter control at all other frequencies. The requirement that the roll gap positioning system move to at least partially compensate for the roll irregularities introduces a consideration not present in strategies which attempt only to eliminate the cyclic components from the control signals. In the present method, the response time of the roll positioning system is a critical factor; it must be short compared to the period of the roll irregularities, or the system will be ineffective. This generally eliminates electromechanical gap control systems from consideration with the present invention. Even hydraulic roll positioning systems may not support the present method at the highest rolling speeds employed in some single stand cold mills. The majority of rolling applications, however, can effectively employ the present method if equipped with widely available hydraulic gap controls.

Mention was earlier made of the term Y which is included in equation (2) and the filter circuit 22 (FIG. 2). This Y factor, a design constant of the filter related to its bandwidth is determined by the expected separation of eccentricity frequencies and incoming strip disturbance frequencies. The considerations for selecting the value of the constant Y are best understood with reference to FIGS. 3 and 4. Referencing first FIG. 3, there is plotted as the abscissa the eccentricity frequency (radians per second) as opposed to the per unit thickness variation which will result from various values of Y for one ratio of mill and workpiece stiffnesses. Values of Y equal to 0.1, 0.5 and 1.0 are shown. For purposes of this illustration, the center frequency of the filter is set at 6 radians per second. It is seen that as the value of Y increases, the curves tend to become more open and hence, from the standpoint of roll irregularities at the particular stand in question, the attenuation of gage variations would be best served by employing a high value of Y, to accommodate inaccuracies in filter tuning. For example, it is seen that in the case of $Y=1$, the amount of variation passed with a one radian per second differential from center frequency of the filter results in very little change in the amount of attenuation achieved. Conversely, with the value of $Y=0.1$, the amount of attenuation that is achieved away from the center of frequency decreases very rapidly.

Figure 4:
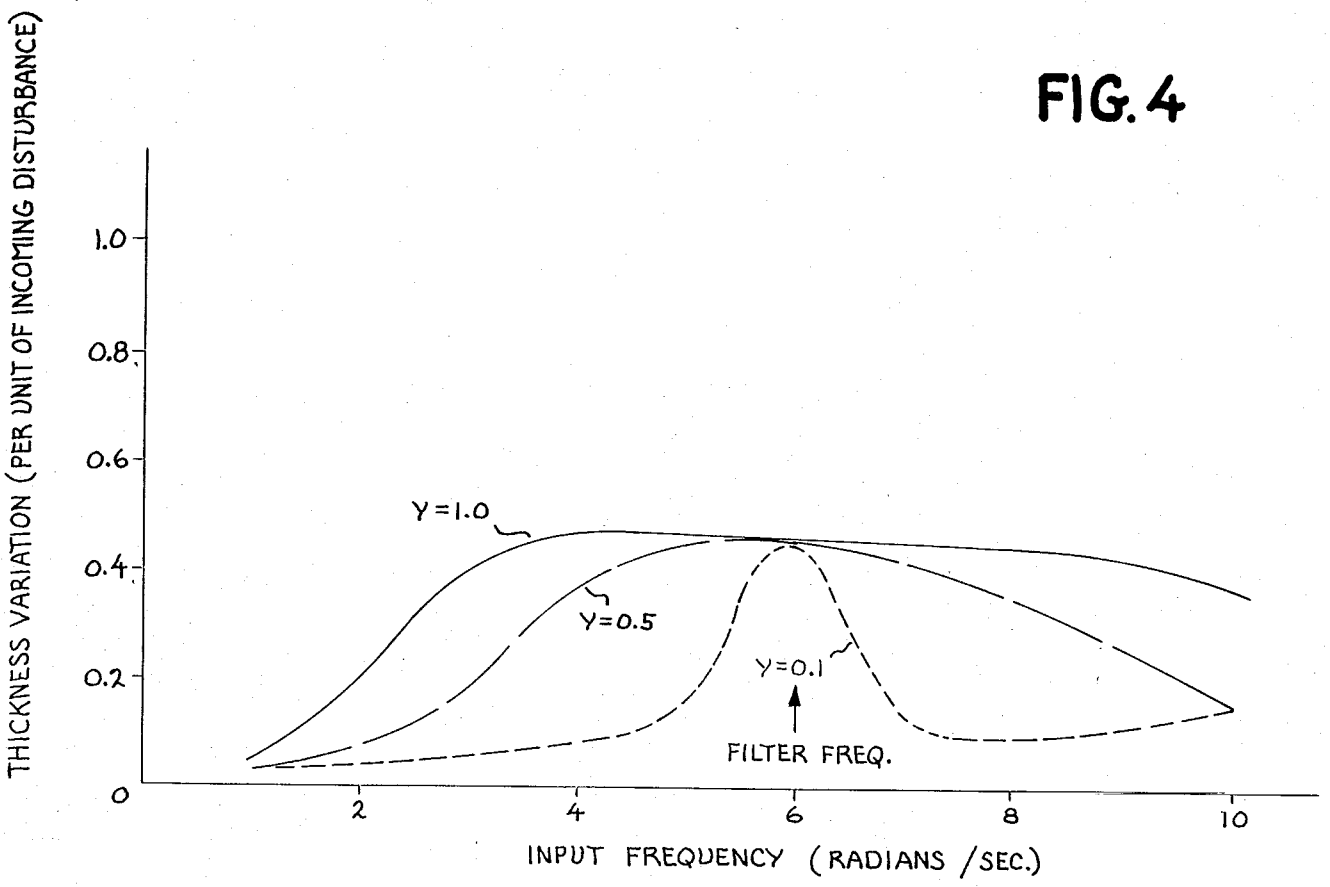

FIG. 4 plots the output thickness variations as a function of the frequency of incoming disturbances and illustrates a different situation. It must be remembered that in a multiple pass mill, whether it be a tandem mill or a reversing mill, cyclic variations from one pass to another may not vary very much. In a reversing mill, the variation in cyclic disturbances due to one pass are seen in the second pass displaced only by the amount of workpiece elongation resulting from the reduction being taken in the present pass. Similarly, in a tandem mill having rolls of the same size, which is the normal case, the same situation exists. Thus, in order to be able to distinguish between force signal variations caused by eccentricity (or ovalness) at the existing stand versus those force signal variations due to gage variations resulting from cyclic variations in the previous pass, the bandwidth passed by the filter should be relatively narrow. This is illustrated in FIG. 4 and is seen that, once again using the center frequency of six radians per second, a value of $Y=0.1$ provides a much more accurate discrimination than the larger values of Y. For example, with $Y=1$ there is essentially no discrimination throughout a wide band of input frequencies. Thus, from this standpoint a very small value of Y is desired. Since the problem of cyclic variation in gage due to roll irregularities of a previous pass of the workpiece through the rolls is more common than wide deviations of irregularity frequencies relating to a particular stand, the common practice will be to provide a value of Y more in the range 0.1 to achieve good filter results.

Figure 5:
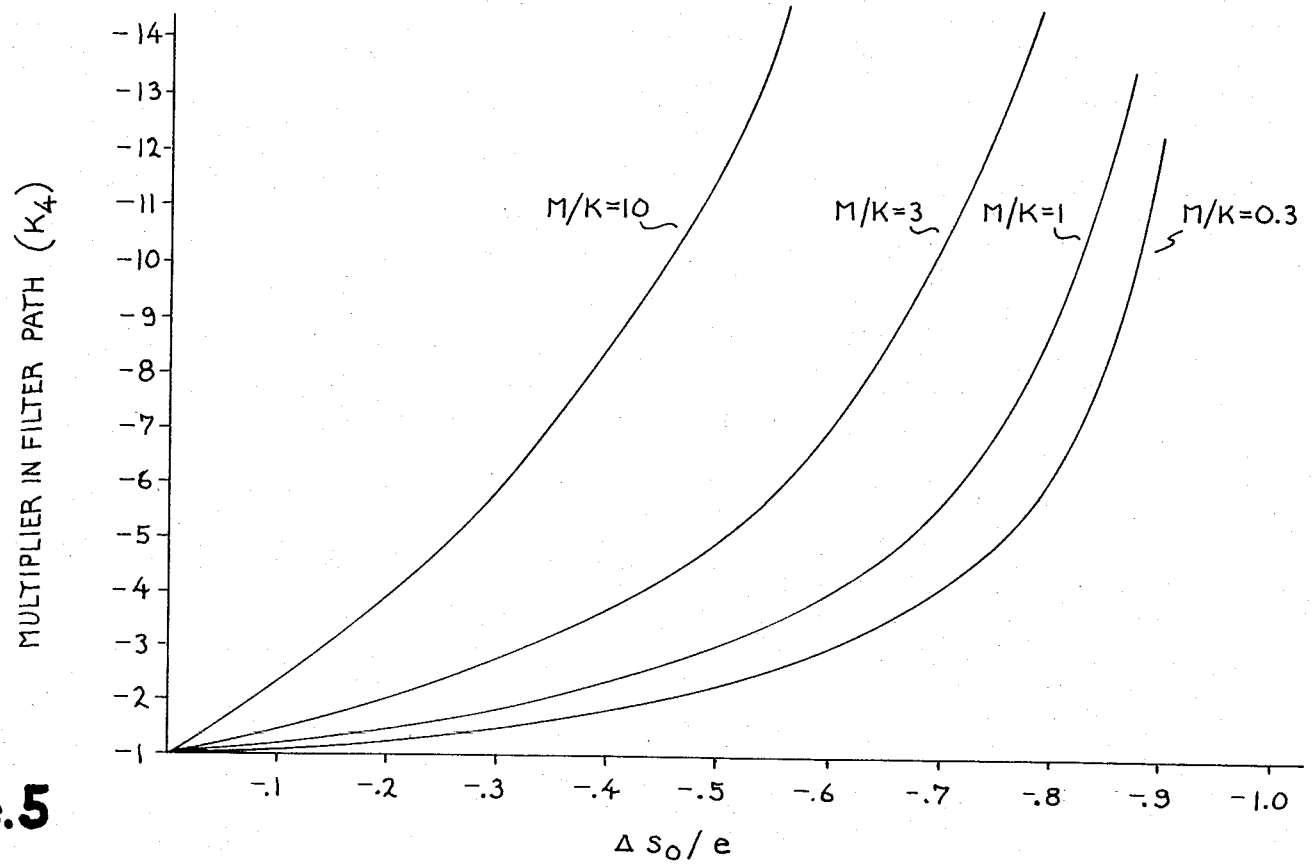

The multiplication factor ($K_4$) of the system was also earlier discussed and FIG. 5 illustrates the parameters covering the choice of this value. In FIG. 5, the abscissa is defined as ($\Delta S_o/e$) which represents the change in roll gap opening as a function of eccentricity (or ovalness). The ordinate of FIG. 5 gives multiplication factor of the filter path, i.e., the approximate value of $K_4$ required to achieve the per-unit correction $\Delta S_o/e$. Four lines are depicted each having a value for the term M/K. In this case M is the mill stiffness coefficient and K is the strip spring constant of the workpiece. Both of these are measured in force units per length units; e.g., pounds per inch. It is evident from FIG. 5 that the softer the workpiece material, the greater the value of the of the multiplier required to effect a given per-unit correction. Thus, if the $(\Delta S_o/e)$ term is considered as a percent correction factor, it is seen that for a 50 percent reduction of the eccentricity imprint the multiplier $K_4$ would be about 2.2 for a relatively stiff workpiece, $M/K=0.3$, whereas the multiplier would have to be about 11 for a relatively soft workpiece of $M/K=10$. FIG. 5 shows that total compensation will require an infinite gain which, of course, is not possible. It is also recognized that high gains increase the risk of amplification of cyclic components not desired to be amplified. It is possible to make a rational judgement regarding the maximum "safe" filter gain ($K_4$). A "safe" gain might be defined as one which will not degrade gage performance when incoming gage variations produced by a previous reduction are at the same frequency as the current pass eccentricity.

If, on each pass, at least the "natural" attenuation due to $(dh/dS_o)$ is achieved, then the gage variation out of pass (n) is $(e)*(dh/dS_o)_n$ and the force variation on pass (n+1) due to this incoming gage variation is:

$$(\Delta F_H)_{n+1}=(e)*(dh/dS_o)_n*(dF/dH)_{n+1}.$$

The force variation on pass (n+1) due to eccentricity is:

$$(\Delta F_e)_{n+1}=(e)*(dF/dS_o)_{n+1};\text{ wherein,}$$

H=entry thickness
h=delivery thickness
$\Delta F_H$=force change due to incoming gage variation
$\Delta F_e$=force change due to eccentricity
$dh/dS_o$=gage change due to roll gap change p1
e=eccentricity
n=pass number Thus, the ratio of force variations from these two sources is:

$$\frac{(\Delta F_e)_{n+1}}{(\Delta F_H)_{n+1}}=\frac{(e)*(dF/dS_o)_{n+1}}{(e)*(dF/dH)_{n+1}\times(dh/dS_o)_n}.$$

Since $(dF/dS_o)_{n+1}\cong(dF/dH)_{n+1}$, $$\frac{(\Delta F_e)_{n+1}}{(\Delta F_H)_{n+1}}\cong\frac{1}{(dh/dS_o)_n}=\left(\frac{dS_o}{dh}\right)_n.$$

Therefore, no degradation can occur on pass (n+1) if the filter gain $K_4$ is equal to or less than $(dS_o/dh)_n$ which ratio is always greater than 1.0. Practically, because of the separation of frequencies even with small drafts, somewhat larger multipliers might safely be used.

The effect of frequency separations is seen in FIG. 4. Frequency separation is related to draft in successive stands through the forward slip in the earlier stand and the reverse slip in the later stand. Assuming forward slip is small compared to reverse slip, that is the neutral point is close to the exit plane, we may assume entry gage cyclic frequency to be (1−r) times stand eccentricity frequency, where "r" is per-unit reduction. The additional attenuation of entry gage cyclic variations (beyond the natural attenuation) can then be read from FIG. 4, or computed from the filter and gage control equations.

Figure 3:
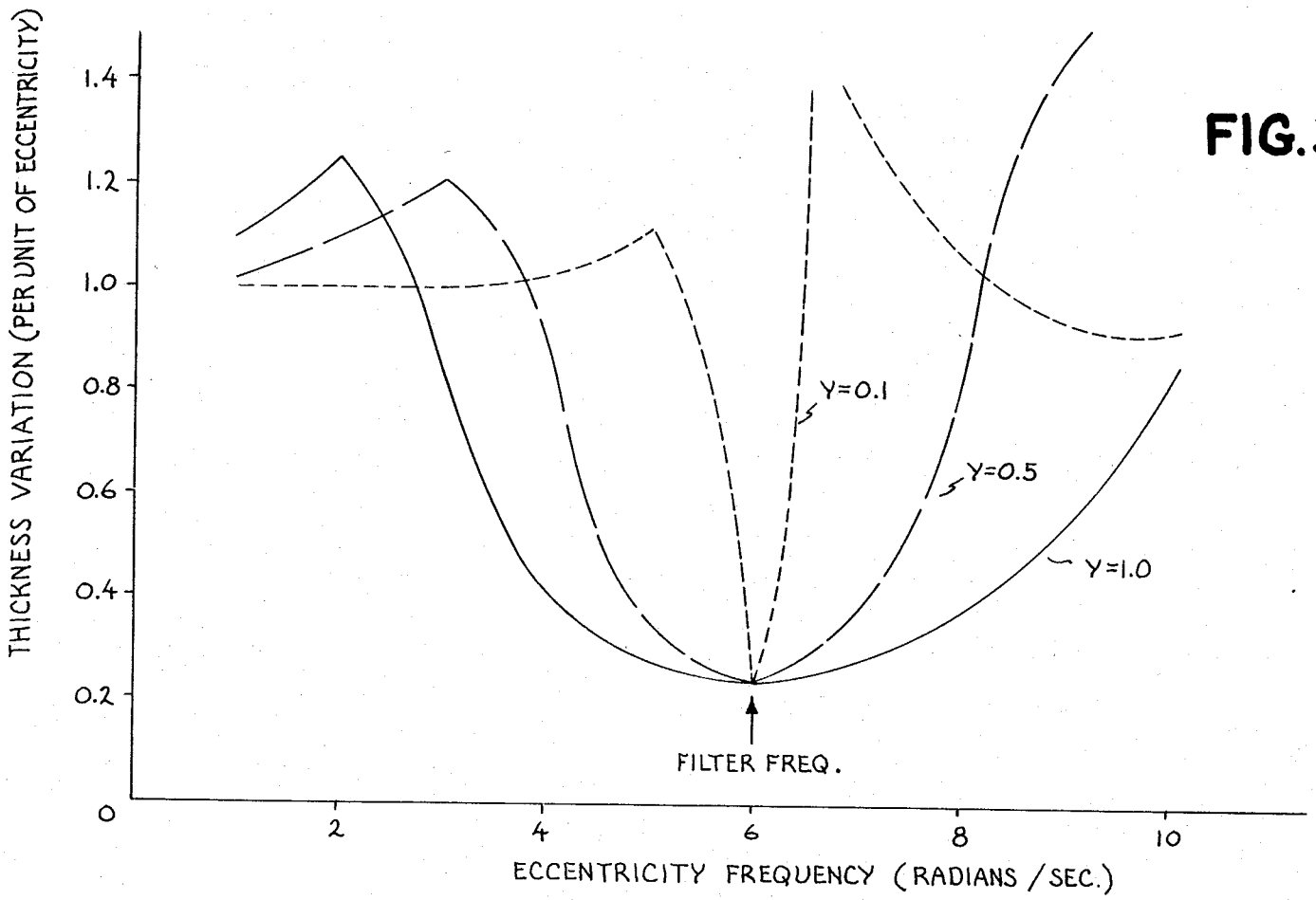

For example, for a 0.33 per-unit draft, input frequency would be about 0.66 of stand frequency, and entry gage variations would be attenuated from 0.45 per unit to 0.09 per-unit, or an additional 5:1 attenuation, for the conditions of FIGS. 3 and 4. A simple, linear approximation of the FIG. 4 attenuation curve for the appropriate Y might be used with the prior logic to provide estimates of $K_4$. For example:

$$K_4\cong\left(\frac{dS_o}{dh}\right)_n*\frac{1}{1-k*r_{n+1}};\text{ wherein,}$$

$r_{n+1}$=per-unit reduction at pass "n+1"
$k\cong2$, for Y in the range 0.1 to 0.2
$K_4\cong6$ (for $dS_o/dh=2$ and $r_{n+1}=0.33$)

Other methods of selecting $K_4$ might be derived from the filter and gage control equations. Since these simple gain selecting techniques do not account for the effects of phase lags in the gap control system, it is necessary to limit the maximum gain to experimentally determined safe levels. A maximum gain of six represents a practical limit, and gains in the range 2.0 to 4.0 give best results in simulation studies.

From the foregoing, it is seen that there has been provided a very simple and economic system for compensating for roll irregularities such as eccentricity and ovalness. The system requires very little additional equipment since it uses previously existing signals within the system and requires only the additional filter circuit(s). It should be noted that the filter type is not of extreme importance to the present invention and while it may be either passive type including resistors, capacitors and inductances, more commonly it would be of the type employing operational amplifiers in the manner known in the art. The system could also be implemented digitally with similar results without deviating from the present invention.

An additional point to be made is that while the invention has been illustrated with respect to four-high stand, it is apparent that a lesser or greater number of rolls could be employed with equal facility. Also, if harmonics of the fundamental frequency of roll rotation were desired to be compensated for, additional parallel connected filters appropriately tuned with their outputs combined to provide the $F_m$ signal could be provided.

While there has been shown and described what is at present considered to be the preferred embodiment of the invention, modifications such as those discussed above will readily occur to those skilled in the art. It is not desired, therefore, that the invention be limited to specific arrangements shown and described and it is intended to cover in the appending claims all such modifications as fall within the true spirit and scope of the invention.

What is claimed is:

1. In a metal rolling mill including rotating rolls for reducing the thickness of a metal workpiece, roll gap adjusting means and automatic gage control means for controlling the roll gap adjusting means as a function of sensed roll separation force, a method for compensating for cyclic workpiece gage variations resulting from roll irregularities comprising:

(a) developing a force signal proportional to the roll separation force occasioned by the workpiece between the rolls;

(b) developing a speed signal proportional to roll rotational speed;

(c) isolating, from said force signal, cyclic components having a frequency which is an integral multiple of the roll rotational speed;

(d) multiplying said cyclic components by a multiplication factor greater than unity to provide a product;

(e) subtracting said product from said force signal to provide a modified force signal; and, (f) applying said modifying force signal to said automatic gage control means to thereby control the gap between said rolls.

2. The invention in accordance with claim 1 wherein said roll irregularity is eccentricity and wherein the integral multiple of cyclic components is one.

3. The invention in accordance with claim 1 wherein the roll irregularity is ovalness and wherein the integral multiple of cyclic components is two.

4. The invention in accordance with claim 1 wherein said multiplication factor is determined as a function of rolling mill stiffness, a spring constant of the workpiece, and a reduction in workpiece thickness resulting from passing the workpiece between the rolls.

5. The invention in accordance with claim 4 wherein said multiplication factor (to rolling mill stiffness and the spring constant of the workpiece) is defined, with respect to said rolling mill stiffness and said spring contact, by the relationship:

$$G = (dS/dh)_n * \frac{1}{1 - k * r_{n+1}}, \; 1.0 < G < 6.0; \text{ wherein,}$$

G=multiplication factor $(dS_o/dh)_n$=ratio of roll gap change to delivery thickness change on pass n $r_{n+1}$=per-unit reduction on n+1 pass k=gain factor dependent on filter bandwidth≅2.0 for typical filter.

* * * * *